US009265348B2

(12) United States Patent
Potrykus

(10) Patent No.: US 9,265,348 B2
(45) Date of Patent: Feb. 23, 2016

(54) ADJUSTING MECHANISM FOR SETTING A RESTORING FORCE WHICH ACTS ON A BACKREST OF A CHAIR, AND OFFICE CHAIR HAVING AN ADJUSTING MECHANISM OF THIS TYPE

(75) Inventor: Martin Potrykus, Bamberg (DE)

(73) Assignee: HAWORTH, INC., Holland, MI (US)

( * ) Notice: Subject to any disclaimer, the term of this patent is extended or adjusted under 35 U.S.C. 154(b) by 0 days.

(21) Appl. No.: 14/236,805

(22) PCT Filed: Aug. 2, 2012

(86) PCT No.: PCT/EP2012/003291
§ 371 (c)(1),
(2), (4) Date: Feb. 3, 2014

(87) PCT Pub. No.: WO2013/017279
PCT Pub. Date: Feb. 7, 2013

(65) Prior Publication Data

US 2014/0159452 A1 Jun. 12, 2014

(30) Foreign Application Priority Data

Aug. 3, 2011 (DE) ..... 20 2011 103 999 U

(51) Int. Cl.
*A47C 1/024* (2006.01)
*A47C 1/032* (2006.01)

(52) U.S. Cl.
CPC ..... *A47C 1/03272* (2013.01); *A47C 1/03266* (2013.01)

(58) Field of Classification Search
CPC ..... A47C 1/03255; A47C 1/03266; A47C 1/03272; A47C 7/443; A47C 7/441
USPC ..... 297/300.2, 300.5, 300.7, 300.8
See application file for complete search history.

(56) References Cited

U.S. PATENT DOCUMENTS 4,962,962 A * 10/1990 Machate et al. ..... 297/300.5
4,966,411 A * 10/1990 Katagiri et al. ..... 297/300.7
(Continued)

FOREIGN PATENT DOCUMENTS

AT 405124 5/1999
EP 2769642 * 8/2014 ..... A47C 1/03255
(Continued)

OTHER PUBLICATIONS

International Search Report and Written Opinion, International Application PCT/EP2012/003291, dated Dec. 13, 2012.

*Primary Examiner* — Laurie Cranmer
(74) *Attorney, Agent, or Firm* — Warner Norcross & Judd LLP

(57) ABSTRACT

The adjusting mechanism serves for the weight-dependent setting of a restoring force which acts on a backrest (4) of an office chair which is configured with a synchronous mechanism. The synchronous mechanism comprises a support (12), a seat support (10) and a backrest support (8) which are connected to one another via joint pins (A1-A4), the restoring force being exerted via a spring element (18). In order to achieve as flat a design as possible, the restoring force is transmitted with the aid of a pivotable lever (16) via a front bearing pin (L1) to a first front joint pin (A1), an active lever length (h) which can be varied with the aid of an adjusting element (20) being defined by the spacing between the bearing pin (L1) and the second front joint pin (A2). A weight setting is made possible by the variation of the active lever length (h).

10 Claims, 6 Drawing Sheets

(56) References Cited

U.S. PATENT DOCUMENTS

Figure 1:
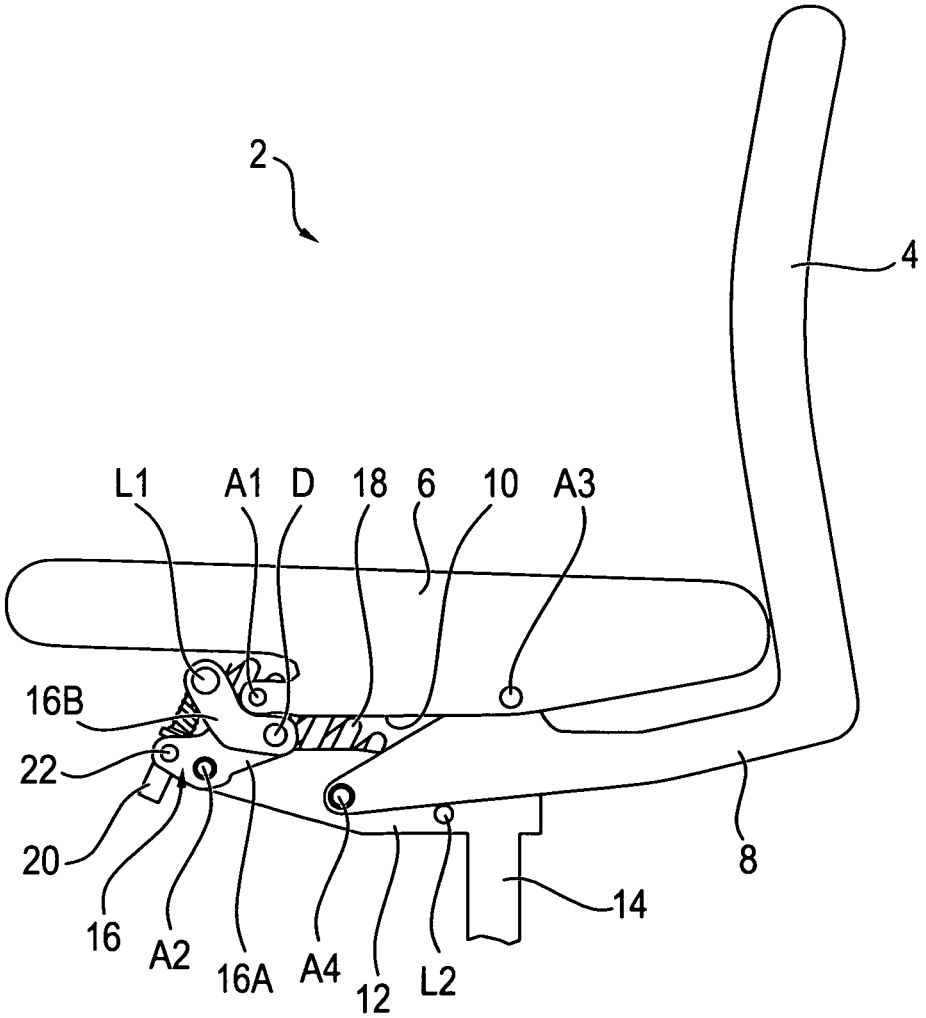

| | | | | |
|---|---|---|---|---|
| 6,234,573 | B1 * | 5/2001 | Roder et al. | 297/300.5 |
| 7,364,233 | B2 * | 4/2008 | Donati | 297/300.2 |

FOREIGN PATENT DOCUMENTS

| | | |
|---|---|---|
| JP | 2003024164 | 1/2003 |
| WO | 2009109275 | 9/2009 |

* cited by examiner

ADJUSTING MECHANISM FOR SETTING A RESTORING FORCE WHICH ACTS ON A BACKREST OF A CHAIR, AND OFFICE CHAIR HAVING AN ADJUSTING MECHANISM OF THIS TYPE

The invention relates to an adjusting mechanism for setting a restoring force which acts on a backrest of a chair, according to the precharacterizing clause of claim 1. Furthermore, the invention relates to an office chair having an adjusting mechanism of this type.

Here, the office chair is equipped with what is known as a synchronous mechanism. The backrest in chairs of this type can usually have its inclination adjusted counter to a restoring force. In the case of comfort chairs, it is provided that this restoring force can be set, in order to adapt it to the requirements of users of different weights.

Here, different mechanisms and methods are possible for the setting operation. Thus, for example, the prestress of a spring which exerts the restoring force can be set manually via an actuating element, such as a handwheel. In order for it to be possible to adjust the spring prestress, however, a very great force is required, with the result that a complicated step-up means is usually required, which also leads to it being necessary for a comparatively large number of revolutions to be carried out, in order to achieve discernible adjustment.

As an alternative, it can be provided to configure an entire spring-assembly arrangement or in general the arrangement of the spring element to be pivotable, with the result that the articulation points of the spring element in the parallelogram of forces are changed. However, this requires a relatively large amount of installation space, since the entire spring element has to be pivoted.

In addition, known setting options have the problem that the ratio of the initial force (in the rest position) exerted by the spring element to the maximum force (in the inclined position) often exhibits an unfavourable response in the case of a performed weight setting. In other words, this means that the restoring force which is exerted by the spring element via the inclination adjusting means of the backrest is perceived differently by a light person and a heavy person, for example in such a way that, in the case of a light person, a soft setting which is first of all perceived as pleasant is perceived to be more and more difficult to turn as the inclination increases, and, for example, vice versa in the case of a heavy person. There is therefore the problem of the correct setting by means of the inclination adjusting means of the backrest.

Furthermore, the prior art has disclosed adjusting mechanisms which, in order to change the restoring force, change an active lever length between a swivelling pin 5 of the backrest support 2 and a point of action of the spring element. Thus, in the case of the mechanism which is known from WO 2006/114250 A1, for example, a roller is adjusted with the aid of a setting lever, which roller is guided firstly along a surface on the backrest carrier and secondly along a surface of a pivoting lever, the roller and the pivoting lever interceding between the point of action of the spring element and the backrest carrier in order to set different active lever lengths.

An adjusting mechanism can be gathered from EP 1 258 212 A2, in which adjusting mechanism the point of action of a spring element on the backrest support can be adjusted in order to change an active lever length between the point of action and the pivot pin. In a similar way, EP 1 258 211 A2 describes a bearing block which can be displaced along a sliding guide in order to set different active lever lengths.

A further adjusting mechanism for setting the restoring force can be gathered from the subsequently published WO 2011/141107 A1. In the said further adjusting mechanism, an adjusting element which is configured as an articulated scissor-type arrangement is provided with two scissor arms, one scissor arm acting on the backrest support and the other scissor arm being connected to a restoring spring. Here, the articulated scissor-type arrangement is arranged in such a way that the position of the spring element remains unchanged in the case of an adjustment of the restoring force by variation of an active lever length. This makes force-free weight adjustment possible overall, with the result that a gear mechanism step-up means is not required and rapid adjustment is made possible.

The known adjusting mechanisms have a comparatively large installation space, however, with the result that the vertical spacing between an upper end of a support column and the seat support is comparatively great.

Proceeding from this, the invention is based on the object of specifying an improved adjusting mechanism for setting the restoring force in a chair of this type, in particular a chair having a synchronous mechanism, which adjusting mechanism requires only a small amount of installation height.

According to the invention, the object is achieved by an adjusting mechanism having the features of claim 1, and by an office chair having an adjusting mechanism of this type. The adjusting mechanism is generally configured for setting a restoring force which acts on a backrest of a chair.

The adjusting mechanism comprises a support which is usually provided for mounting on a support column of a pedestal frame, a seat support, on which a seat cushion or a seat plate is fastened, and a backrest support, to which a backrest is fastened. The support is usually fixed in a stationary manner on the support column of the chair. The seat support, the backrest support and the support are fastened reciprocally to one another via joint pins. This articulated connection of these three structural units serves to form a synchronous mechanism, as is generally known and as can be implemented in a very wide variety of embodiments.

Furthermore, the adjusting mechanism comprises a spring element, via which a restoring force is exerted on the backrest support in such a way that the backrest support is moved via the restoring force into an initial position. The spring element extends generally between a front bearing pin which faces away from the backrest and a rear bearing pin which faces the backrest, on which bearing pins the spring is mounted. It is then of particular significance that the restoring force which acts on the backrest support is transmitted with the aid of a pivotable lever from the front bearing pin of the spring element to a front joint pin of the synchronous mechanism. The lever therefore connects the bearing pin to the front joint pin. It is provided, furthermore, that the spacing between the bearing pin and the joint pin which defines, as it were, an active lever length can be varied with the aid of an adjusting element. Here, the connecting line between front bearing pin and front joint pin defines a lever direction.

The particular advantage of this embodiment is to be seen in the fact that the variable bearing point of the spring element is arranged adjustably in a front region in order to set the weight and acts on the front bearing end of the spring element. Generally, "front" is understood to be that region of the chair which faces away from the backrest. In particular, front region is understood to be a region in front of the support column, on which the support is arranged, that is to say in front of the fastening point of the support column on the support. As a result of the arrangement in the front region, the adjusting mechanism for weight setting is therefore displaced forwards out of the region between seat support and support column, with the result that overall the installation space between support column and seat support, in particular the overall height, can be reduced. The overall result of this is an adjusting mechanism with a very flat construction which is also advantageous in terms of design aspects.

Here, the spring element is preferably configured as a compression spring (helical spring) which extends, in particular, so as to be inclined in a slightly falling manner from the front in the direction of the backrest support. Here, the spring element is preferably mounted with its backward, rear bearing pin in the front region in front of the support column.

For a particularly effective embodiment of the synchronous mechanism, the lever connects the support to the seat support via two front joint pins. The lever is therefore connected to the seat support via a first front joint pin and to the support via a second front joint pin. Furthermore, the seat support is usually connected via a first rear joint pin to the backrest support, and the latter is connected via a second rear joint pin to the support. Overall, four joint pins are therefore provided, via which the lever, the seat support, the backrest support and the support are connected to one another in the manner of a parallelogram in order to form a multiple-pivot synchronous mechanism. The spring element acts on the lever, the point of force action of the spring element being variable with regard to the lever.

In one expedient embodiment, the front bearing pin of the spring element is arranged in front of a connecting line between the front joint pins; the bearing point of the spring element is therefore, as it were, offset to the front beyond the pivot mechanism of the synchronous mechanism.

The lever is advantageously of multiple-part, in particular two-part configuration and has a first lever arm which connects the front joint pins to one another, and a second lever arm which receives the front bearing pin. The two lever arms are mounted on one another in a bearing.

They are preferably mounted on one another such that they can be rotated about a swivelling pin. As an alternative, the lever arms are mounted on one another displaceably, for example with the aid of a mechanical, if required also curved, slotted guide. However, tests have shown that a rotational movement about the bearing point requires a considerably lower effort for the setting of the restoring force, which is advantageous, in particular, in the case of manual adjustability.

Here, in one preferred embodiment, the second lever arm is of bent-over and, in particular, approximately L-shaped configuration. The second lever arm therefore has two part arms which are preferably oriented at an obtuse angle to one another. The first front joint pin preferably lies in this angular region between the part arms, with the result that a strut of the seat support therefore reaches into this angular region in a manner which is optimized with respect to installation space.

Furthermore, a direction of extent, defined by a connecting line between the front bearing pin of the spring element and the bearing (swivelling pin between the two lever arms), preferably extends approximately parallel to the longitudinal direction of the spring element, that is to say, for example, +/−15° deviation from the longitudinal direction of the spring element in the initial state in the case of a non-inclined backrest. As a result, a setting option for the active lever length which is as free of force as possible is achieved. This is because a pivoting movement about the connecting pin between the two lever arms in the case of a setting operation of the restoring force leads to no or only a small length change of the restoring spring in this arrangement. Only a small effort is therefore required, with the result that no, or at least no great, step-up means is required, even in the case of manual adjustment, that is to say rapid adjustment is made possible. Merely frictional forces to be overcome remain substantially.

The swivelling pin (that is to say, the bearing) between the two lever arms is expediently arranged behind the connecting line between the front joint pin and the front bearing pin, with the result that the second lever arm crosses this connecting line, as it were. As a result, the front bearing point of the spring element can be moved forwards independently of the synchronous mechanism. At the same time, a long second lever arm is formed, which has an advantageous effect on the adjusting forces to be exerted.

The adjusting element is expediently mounted on both lever arms, with the result that, in the case of an adjustment, the two lever arms are adjusted relative to one another. Since one lever arm is connected to the front bearing pin and the other is connected to the front joint pin, the active lever length is varied in an effective way as a result. Together with the adjusting element, the lever arms therefore form, as it were, an independent adjusting structural unit. The bearing points of the adjusting element on the lever arms are preferably in front of the connecting line between front bearing pin and front joint pin. In one preferred embodiment, the bearing point on the first lever arm is spaced apart from the joint pin, the lever arm being of bent-over configuration to this end, in particular. The bearing point on the second lever arm preferably coincides with the bearing pin.

The longitudinal direction which is defined by the spring element is expediently oriented at an angle of action β with respect to the lever direction. In order to achieve a satisfactory transmission of force, this angle of action is approximately a right angle and lies, for example, in a range from 50 to 130° and preferably in a range between 75° and 105° (in the non-inclined state).

The angle of action is expediently variable during the inclination adjustment, to be precise in such a way that it changes in the direction of a right angle as the inclination position increases. In the case of a completely inclined backrest, it preferably assumes a value of approximately 90°. This achieves a situation where the restoring force which acts on the backrest remains approximately the same or possibly even increases somewhat, even as the inclination adjustment increases. On account of the multiple-pivot synchronous mechanism which is configured, in particular, in the manner of a 4-pivot mechanism, in which the total of 4 joint pins define the end points approximately of a trapezium, the rotational angle about the front joint pins becomes proportionately smaller as the inclination adjustment increases, that is to say, as the inclination adjustment increases, the adjusting travel of the spring per unit of inclination angle becomes smaller. The force which is required for the inclination adjustment would become smaller in the case of increasing inclination without variable angle of action. The variable angle of action therefore compensates for this effect.

Here, a spindle which, in particular, can be actuated manually and is preferably self-locking is preferably provided as adjusting element.

In general, the adjusting mechanism is configured here in such a way that the restoring force is increased as the active lever length increases.

Figure 2:
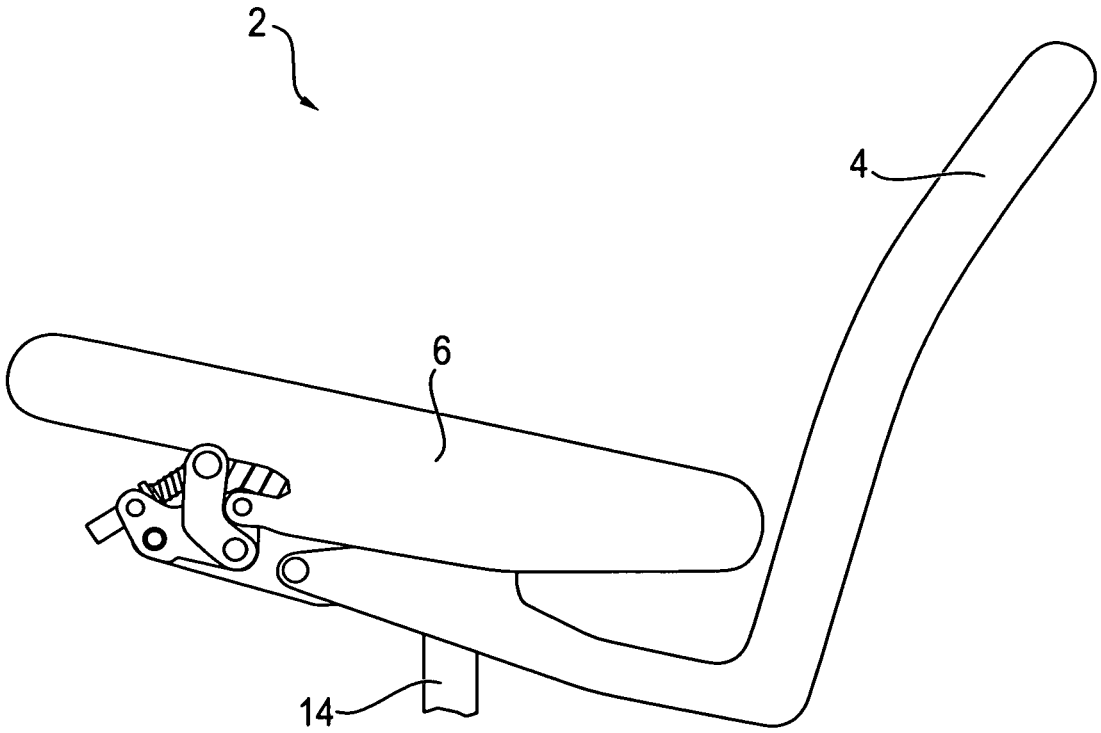
Figure 3:
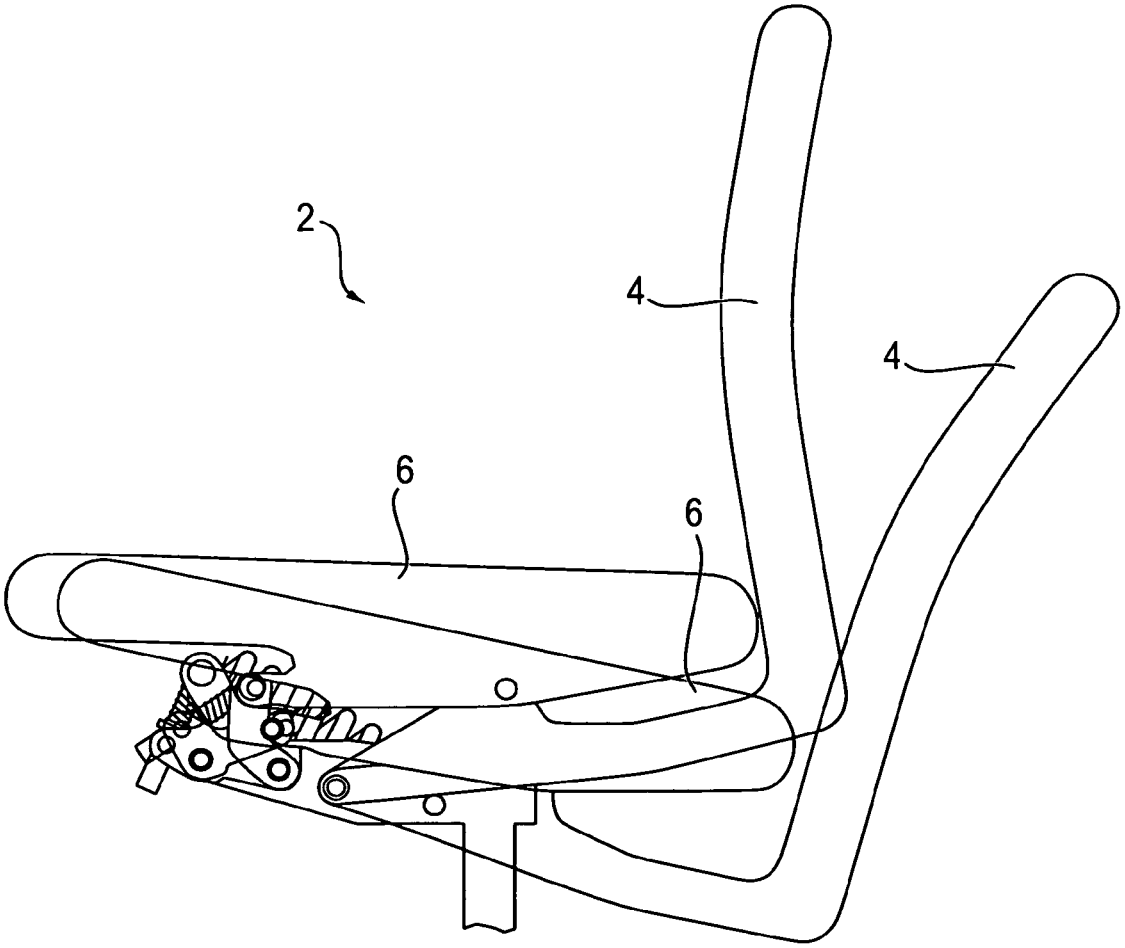
Figure 4A:
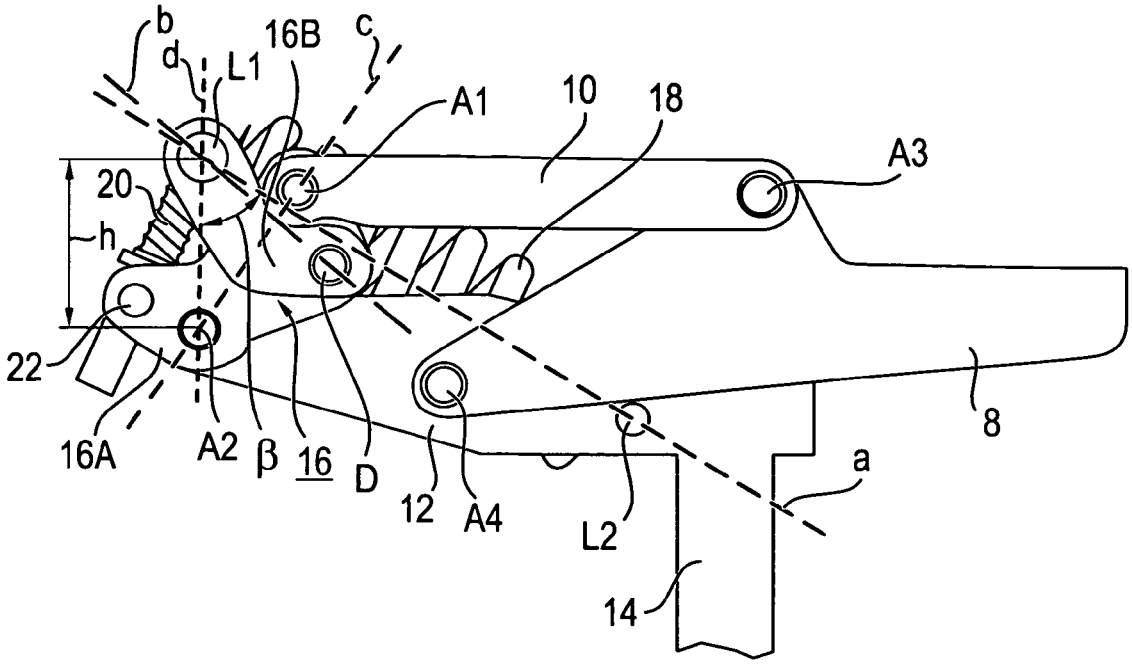
Figure 4B:
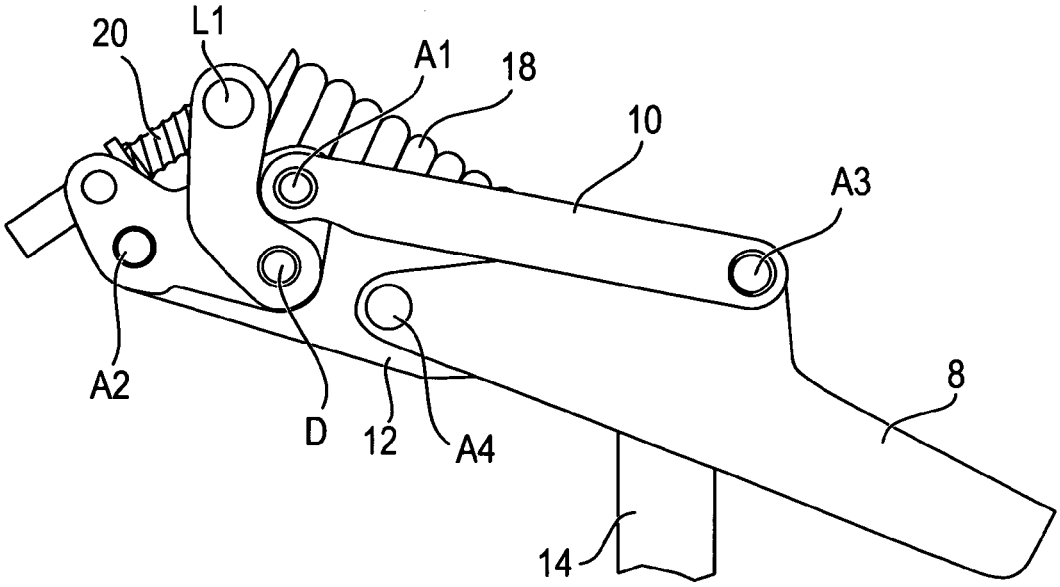
Figure 5A:
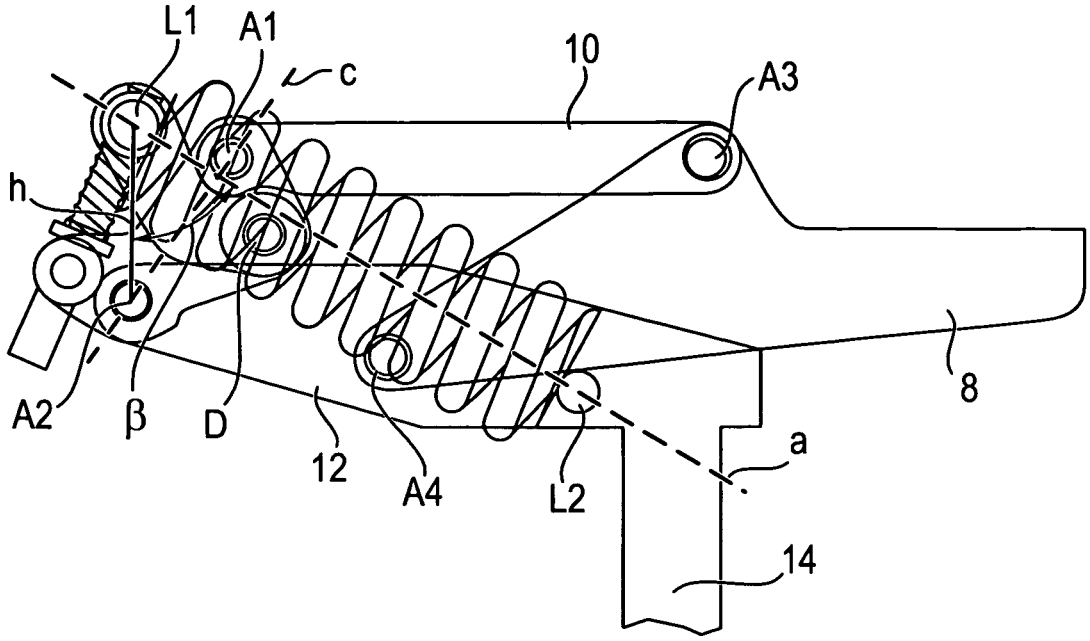
Figure 6A:
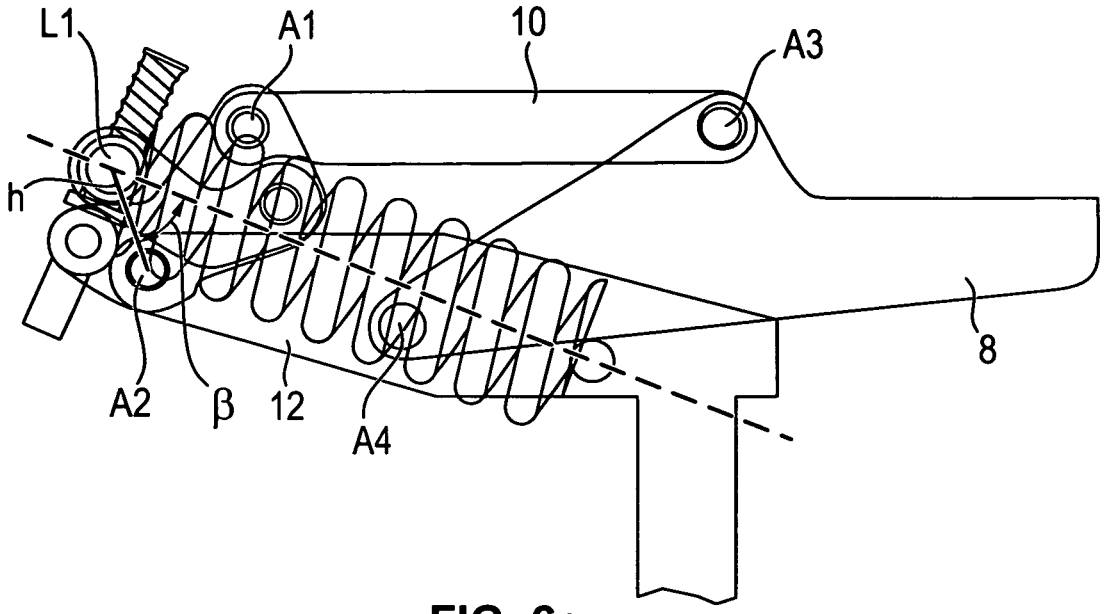
Figure 6B:
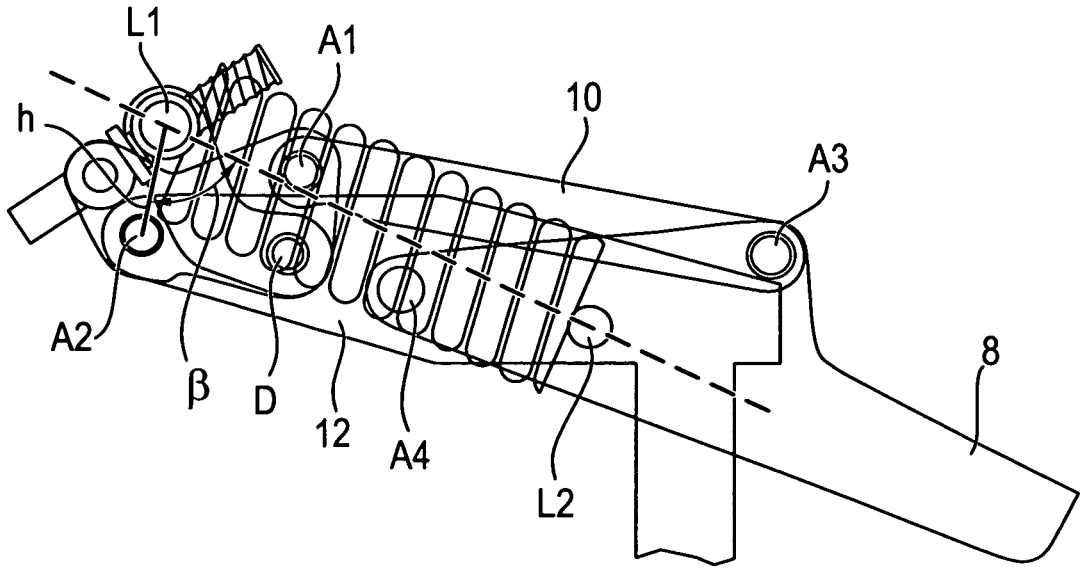

One exemplary embodiment of the invention will be explained in greater detail using the figures, in which:

FIG. 1 shows a side view of a detail of an office chair in the normal position, FIG. 2 shows a side view of the office chair which is shown in FIG. 1, in an inclined position, FIG. 3 shows a superimposition of the illustrations according to FIGS. 1 and 2, FIG. 4*a* shows a side view of the seat mechanism in the "heavy" weight setting, in the initial position, FIG. 4*b* shows the side view according to FIG. 4*a*, in the inclined position, FIGS. 5*a, b* show illustrations which correspond to FIGS. 4*a, b*, with transparently illustrated components, FIG. 6*a* shows a side view of the seat mechanism with transparently illustrated components in the initial position, in the "light" weight setting, and FIG. 6*b* shows the illustration according to FIG. 6*a*, in the inclined position.

The chair 2 which is shown in the figures is, in particular, an office chair which is configured with a synchronous mechanism. It comprises a backrest 4 and a seat 6. The backrest 4 is fastened to a backrest support 8 and the seat 6 is fastened to a seat support 10. The seat support 10 and the backrest support 8 are in turn fastened to one another and to a support 12 via joint pins A1 to A4. The support 12 in turn is connected to a support column 14 which ends on the floor side in a pedestal frame which is not shown here in greater detail.

The joint pins can be differentiated into the two front joint pins A1, A2 and the two rear joint pins A3, A4. The two front joint pins A1, A2 are connected to one another via a two-part lever 16 which has a first lever arm 16A and a second lever arm 16B. The first lever arm 16A connects the two joint pins A1 and A2 in a pivotably movable manner. The second lever arm 16B is mounted on the first lever arm 16A such that it can be moved rotatably on a swiveling pin D. The connecting line between the two joint pins A1, A2 defines a lever direction c.

Furthermore, a spring element 18 is provided which is configured, in particular, as a compression spring (helical spring) and extends in the longitudinal direction a from a front bearing pin L1 to a rear bearing pin L2. A plurality of spring elements 18 are preferably arranged next to one another on the pins L1 and L2.

The connecting line between the second front joint pin A2 and the front bearing pin L1 defines a lever direction d, and the spacing between the said two pins defines an active lever length h. The connecting line between the front bearing pin L1 and the swivelling pin D defines a direction of extent b (cf. FIG. 4*a*).

Furthermore, an adjusting element 20 is arranged which is configured, in particular, as a spindle and acts with its upper end on the front bearing pin L1 and therefore on the second lever arm 16B. The adjusting element 20 is fastened to the first lever arm 16A via a counterbearing 22. Here, the counterbearing 22 is formed on a bent-over part region of the first lever arm 16A such that it is spaced apart from the second joint pin A2. The adjusting element 20 is mounted in each case in a rotatably movable manner on the two lever arms 16A, 16B or is connected in a rotatably movable manner to the latter via corresponding shafts. The support 12 is usually configured in the manner of a shell-shaped housing which is delimited laterally by side walls and, in between, has a cavity for receiving the synchronous mechanism with the individual elements.

The longitudinal direction a is inclined so as to fall slightly obliquely to the rear, the spring element 18 being arranged completely in the front region, that is to say in front of the support column 14. In the initial position, that is to say in the case of a non-inclined backrest support 8, as is shown in FIGS. 4A, 5A and 6A, the direction of extent b extends as far as possible parallel to the longitudinal direction a and, with respect to the latter, encloses merely a small acute angle in the region preferably of at most 25°.

Figure 5B:
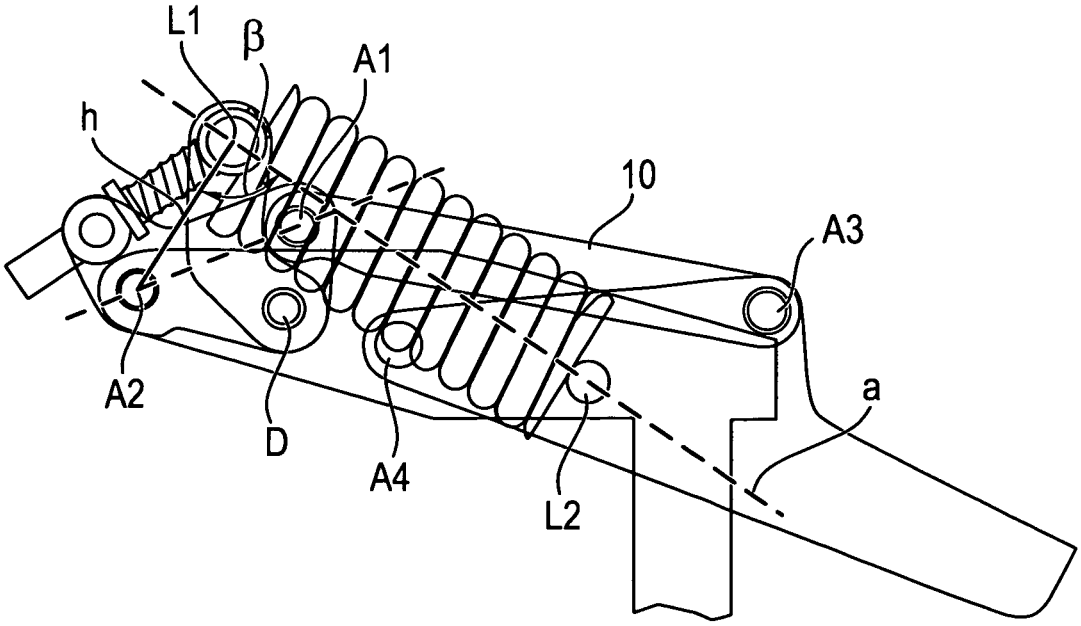

An angle of action β which preferably deviates by from 20° to 40° from a right-angled orientation in the initial state in the case of a non-inclined backrest support 8 is enclosed between the lever direction d and the longitudinal direction a of the spring element 18. This deviation is preferably reduced as the backrest support 8 is inclined, to such an extent that the deviation is only now a few degrees, for example 10°, from a right-angled arrangement, or the right-angled arrangement is assumed, as is achieved in the case of the variant according to FIG. 5*b* with a "heavy" weight setting.

The synchronous mechanism is substantially formed from the seat support 10, the backrest support 8 and the two-part lever 16, which are fastened to one another in each case in an articulated manner via the joint pins A1 to A4. Here, the lever 16 is attached in an articulated manner to one of the front joint pins A2 and the backrest support 8 is attached in an articulated manner to one of the rear joint pins A4 on the stationary support 12. The joint pins A1-A4 therefore approximately define a parallelogram.

For the weight setting, the active lever length h can be varied via the spindle 20 which is, in particular, self-locking. Here, as the active lever length h increases, the weight setting is adjusted from light to heavy.

The spring element 18 in principle exerts a restoring force on the backrest support 8, that is to say counteracts a rotational movement of the backrest support 8 about the joint pin A4. As becomes clear, in particular, in a comparison of FIGS. 5*a*, 5*b* (heavy weight setting, long active lever length h) with FIGS. 6*a*, 6*b* (light weight setting, short active lever length h), the overall adjustment travel of the compression spring 18 is greater in the case of the "heavy" weight setting than in the case of the "light" weight setting, that is to say the spring travel is greater in the case of the "heavy" weight setting. Furthermore, the torque which is exerted by the spring element 18 is greater in the case of the "heavy" weight setting than in the case of the "light" weight setting. As can be seen, in the case of an inclination adjustment, the seat support 10 is guided obliquely rearwards and downwards, with the result that the lever 16 rotates about the front swivelling pin A2. This rotational movement about the swivelling pin A2 counteracts the spring force of the spring element. In the case of the "heavy" weight setting with the great active lever length h, the force action of the spring is spaced further apart from the swivelling pin A2 and therefore exerts a greater counter-torque.

With regard to the desired flat design, it is of particular significance that the spring element 18 acts on the lever 16 in the front region. In particular, the bearing point which is defined by the front bearing axis L1 is arranged in front of the actual multiple-pivot synchronous mechanism, that is to say in front of the connecting line c between the front joint pins A1, A2.

The spring element 18 extends in a slightly obliquely inclined manner to the rear and is mounted on the rear bearing pin L2. In the exemplary embodiment, the latter is likewise also situated in front of the support column 14. The entire mechanism for setting and exerting the restoring force on the backrest 4 is therefore arranged in the front region of the seat mechanism in front of the support column 14.

Here, the spring element 18 is arranged such that it is inclined obliquely approximately at an angle of 30° with regard to the horizontal.

The direction of extent b) between the front bearing pin L1 and the swivelling pin D, that is to say substantially the direction of extent of the second lever arm 16*b*, extends at least approximately in the longitudinal direction a, in the exemplary embodiment merely at a slight acute angle approximately in the region of 10°. In the case of an adjustment of the active lever length h, a rotational movement of the bearing pin L1 about the swivelling pin D therefore takes place. As a result of the approximately parallel orientation and, in addition, as a result of the comparatively great length (great spacing between L1, D), the length change of the compression spring 18 is low in the case of an adjustment of the active lever length h. Only a low force therefore has to be applied counter to the spring force in the case of an adjustment of the active lever length h. Here, it is provided in an expedient embodiment that the spring force even assists the adjusting movement for an adjusting direction, for example, from heavy to light or from light to heavy.

The adjustment generally takes place in a way which is not shown here in greater detail, for example via a handwheel which acts on the spindle 20 via a type of bevel gear and sets the said spindle 20 in rotation. The spindle 20 is mounted in a corresponding spindle nut on a bent-over projection of the first lever arm 16*a*.

In order to achieve a desired profile of the restoring force over the inclination adjustment, it is provided, furthermore, that the angle of action β which is acute in the unloaded state in the exemplary embodiment and is approximately 75° increases as the inclination adjustment increases, in order to achieve nearly 90° in the case of a completely inclined backrest support 8, with the result that a right-angled force action takes place with an optimum degree of efficiency. This compensates for the fact that, on account of the special embodiment of the 4-pivot synchronous mechanism, the rotational angle about the joint pin A2 becomes proportionately smaller as the inclination adjustment increases, which, without this compensation effect, would lead to the adjustment travel of the spring per unit of inclination angle becoming smaller as the inclination adjustment increases. Without a compensation effect, this would lead to the restoring force becoming smaller as the inclination increases and there being the risk correspondingly that the said restoring force is no longer sufficient.

LIST OF REFERENCE NUMERALS

2 Chair
4 Backrest
6 Seat
8 Backrest support
10 Seat support
12 Support
14 Support column
16 Lever
16A First lever arm
16B Second lever arm
18 Spring element (compression spring)
20 Adjusting element (spindle)
22 Counterbearing
A1-A4 Joint pins of the 4-pivot synchronous mechanism in the exemplary embodiment
L1 Front bearing pin for the spring element
L2 Rear bearing pin for the spring element
D swivelling pin (bearing)
h Active lever length
a Longitudinal direction of the spring element
b Direction of extent between bearing pin Li and swivelling pin D
c Connecting line A1-A2
d Lever direction
β Angle of action (between active lever length h and longitudinal axis a)

The invention claimed is:

1. An adjusting mechanism for a weight-dependent setting of a restoring force which acts on a backrest (4) of a chair which is configured with a synchronous mechanism, comprising a support (12), a seat support (10) and a backrest support (8) which are connected to one another via joint pins (A1-A4) so as to form the synchronous mechanism, and having a spring element (18) for generating the restoring force, which spring element (18) extends along a longitudinal direction (a) between a front bearing pin (L1) and a rear bearing pin (L2), wherein the restoring force is transmitted with the aid of a lever (16) via the front bearing pin (L1) to a front joint pin (A2), a lever direction (d) being defined by a connecting line between the front joint pin (A2) and the front bearing pin (L1), and an active lever length (h) which can be varied with the aid of an adjusting element (20) being defined by the spacing between the bearing pin (L1) and the front joint pin (A2), the lever (16) connects the support (12) and the seat support (10) to one another via two front joint pins (A1, A2).

2. Adjusting mechanism according to claim 1, characterized in that, as viewed in a viewing direction towards the backrest (4), the front bearing pin (L1) is arranged in front of a connecting line (c) between the front joint pins (A1, A2).

3. Adjusting mechanism according to claim 1, characterized in that the lever (16) has a first lever arm (16A) which connects the front joint pins (A1, A2) to one another, and a second lever arm (16B) which receives the front bearing pin (L1) and is mounted, in particular rotatably, on a bearing (D) on the first lever arm (16A).

4. Adjusting mechanism according to claim 3, characterized in that the second lever arm (16B) is of bent-over and, in particular, approximately L-shaped configuration.

5. Adjusting mechanism according to claim 4, characterized in that a direction of extent (b) which extends approximately parallel to the longitudinal direction (a) of the spring element (18) is defined by a connecting line between the front bearing pin (L1) and the bearing (D).

6. Adjusting mechanism according to claim 3, characterized in that, as viewed in a viewing direction towards the backrest (4), the bearing (D) is arranged behind a connecting line (c) between the front joint pins (A1, A2).

7. Adjusting mechanism according to claim 3, characterized in that, in order to vary the active lever length (h), the adjusting element (20) is fastened to the two lever arms (16A, 16B) in order to adjust their relative position.

8. Adjusting mechanism according to claim 1, characterized in that the longitudinal direction (a) of the spring element (18) is oriented at an angle of action (β) with respect to the lever direction (d), which angle of action (β) lies in the range from 50° to 130°.

9. Adjusting mechanism according to claim 1, characterized in that the longitudinal direction (a) of the spring element (18) is oriented at an angle of action (β) with respect to the lever direction (d), the angle of action (β) changing in the direction of a right angle in the case of an increasing inclination of the backrest support (8), and preferably assuming approximately 90° in the case of a completely inclined backrest support (8).

10. Adjusting mechanism according to claim 2, characterized in that the adjusting element (20) is a spindle which is, in particular, self-locking.

* * * * *